343-909 SR
7/3/79 OR 4,160,254

United States Patent [19]
Wise

[11] 4,160,254
[45] Jul. 3, 1979

[54] MICROWAVE DICHROIC PLATE

[76] Inventors: Robert A. Frosch, Administrator of the National Aeronautics and Space Administration, with respect to an invention of Thomas E. Wise, Derwood, Md.

[21] Appl. No.: 878,542

[22] Filed: Feb. 16, 1978

[51] Int. Cl.[2] ..... H01Q 15/00
[52] U.S. Cl. ..... 343/909
[58] Field of Search ..... 343/781 CA, 840, 909, 343/911 R

[56] References Cited

U.S. PATENT DOCUMENTS

| | | | |
|---|---|---|---|
| 3,769,623 | 10/1973 | Fletcher | 343/781 CA |
| 3,978,486 | 8/1976 | Reinders | 343/909 |
| 4,017,865 | 4/1977 | Woodward | 343/781 CA |

*Primary Examiner*—Eli Lieberman
*Attorney, Agent, or Firm*—Ronald F. Sandler; John R. Manning; John O. Tresansky

[57] ABSTRACT

A dichroic plate for microwave energy includes an array of interlaced crossed slots or dipole elements. Each of the elements includes first and second crossed arms that are at approximately right angles to each other and aligned with X and Y axes. The elements are arranged so that the centers thereof are aligned parallel to the X and Y axes to form columns and rows, and the interlacing is such that a line between the centers of all adjacent elements has non-zero, differing components relative to the X and Y axes. In one embodiment, the spacing between adjacent arms of different, adjacent elements is the same along the X and Y axes, while in a second embodiment, the spacing between similarly directed arms of adjacent elements differs from the spacing between oppositely directed arms of adjacent elements.

7 Claims, 5 Drawing Figures

MICROWAVE DICHROIC PLATE

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457), and may be manufactured and used by or for the Government for governmental purposes without the payment of any royalties thereon or therefor.

FIELD OF THE INVENTION

The present invention relates generally to microwave dichroic plates and more particularly to a dichroic plate including an array of interlaced crossed slots or dipoles.

BACKGROUND OF THE INVENTION

Microwave dichroic plates are employed with Cassegrain antennas to reflect signals in one frequency band and to pass signals in a second frequency band. One prior art dichroic plate, as illustrated in FIG. 1, employs an array of crossed dipoles 11 having centers 12 that lie along rows and columns 15 and 16, respectively parallel to X and Y axes of a Cartesian coordinate system. Each of crossed dipoles 11 includes a pair of arms 17 and 18 that are crossed with each other to have orthogonally directed longitudinal axes. Each of arms 17 and 18 has approximately the same length, approximately ½ the wavelength of a cut-off frequency of the array, i.e., the frequency that separates the frequency bands thare are reflected and passed by the plate. The longitudinal axes of arms 17 and 18 are inclined at 45° relative to the X and Y axes. Because centers 12 of adjacent ones of elements 11 are either parallel with the X and Y axes or a line between adjacent elements has a 45° angle relative to the X and Y axes, a line between the centers of the adjacent elements has a zero component relative to either the X or Y axis, or the X and Y components of the line are the same.

A plate constructed in accordance with FIG. 1 has the disadvantage of a relatively large separation between centers 12 of adjacent elements 11. As the spacing between the dipole arms of adjacent elements approaches zero, the separation between the centers of the adjacent elements approaches $\sqrt{2/3}$ (approximately 0.471) of the wavelength of the plate cut-off frequency. It is desired to minimize the spacing between the centers of adjacent elements to minimize grating lobes of the high frequency electromagnetic energy propagated through the plate. Grating lobes reduce the energy passed through the dichroic plate along an antenna boresight axis, and decrease the bandwidth that can be passed through the plate. It has also been demonstrated both empirically and theoretically that higher order modes exist in the slots for asymmetrical excitations, and these higher order modes combine with the dominant, low order, mode and the losses so produced also limit the available band width. The energy reduction and higher order modes are particularly significant if the plate, or a portion of the plate, is inclined relative to the boresight axis of a high frequency feed, such as employed in a Cassegrain antenna. Because dichroic plates frequently have a hyperbolic reflecting surface in a Cassegrain antenna, it is apparent that a considerable portion of the plate is inclined relative to the boresight axis and all off-axis impinging energy impinges the plate at angles of incidences greater than zero.

BRIEF DESCRIPTION OF THE INVENTION

In accordance with the present invention, a crossed dipole dichroic plate is formed by interlacing the crossed dipole or slot elements to reduce the center-to-center spacing between adjacent elements, thereby to minimize higher order mode losses and grating lobes and thus increase the bandwidth of an antenna with which the plate is used, as well as to increase the high frequency energy which is passed through the plate. The higher order losses of the prior art can be reduced and/or confined to a narrow frequency band, in accordance with the invention, because there is a reduction in the spacing between elements, with an associated increase in bandwidth. Interlacing the crossed slot or dipole elements implies forming the elements on the plate so that there is an overlap of the arms of adjacent elements. In particular, the first and second arms of each element are oriented parallel to X and Y axes of the array, and the centers of adjacent elements are such that a line between then has nonzero, differing components relative to the X and Y axes. This is in contrast to the prior art configuration illustrated in FIG. 1 wherein a line between centers 12 either lies along the X or Y axis, or makes a 45° relative to the X and Y axes so that its components are the same relative to the axes.

In accordance with one embodiment of the invention, the spacing between adjacent arms of different, adjacent elements is the same along the X and Y axes. In this embodiment, the separation between the centers of adjacent elements is relatively small, approaching a minimum of $(\sqrt{5/6})\ \lambda o$ (approximately $0.37\lambda o$), where $\lambda o$ = the wavelength of the cut-off frequency, as the spacing approaches zero if the ratio of the total length of each element along one of the axes to the width of the element along the orthogonal axis is equal to 3. In one configuration, the line between adjacent centers subtends an angle of approximately 26.57° relative to one of the X or Y axes. For a realistic situation, the length of each element is in the range of between ½ wavelength and ¾ wavelength of the cut-off frequency, and the center separation between adjacent elements is between approximately $0.4\lambda o$ and $0.6\lambda o$.

In accordance with a second embodiment, the center separation is reduced further by reducing the width of each arm of an element and arranging the elements so that the spacing between similarly directed arms of adjacent elements differs from the spacing between oppositely directed arms of adjacent elements. In the limiting situation where the spacing approaches zero, the center separation between adjacent elements approaches $\frac{1}{4}\lambda o$. In one particular configuration, wherein the spacing between the centers of adjacent elements is approximately $0.4\lambda o$, a line between adjacent centers subtends an angle of approximately 19.44° relative to one of the X or Y axes.

In accordance with a third embodiment, there is a reduction of center separation by making the spacing between parallel adjacent edges of first and second arms of adjacent first and second elements equal to the spacing between the tip of the first arm and an edge of a third arm of the second element, wherein the third arm extends at right angles relative to the first and second arms. In this configuration, the center separation approaches $0.25\lambda o$ for an element length of $0.5\lambda o$, as the spacing between the edges of the first and second arms approaches zero and as the ratio of the width of each arm to the length of each element approaches zero. In one particular configuration, wherein the spacing between the centers of adjacent elements is approximately $0.3\lambda o$, a line between adjacent centers subtends an angle of approximately 13.92° relative to one of the X or Y axes.

It is believed that the dichroic plate of the present invention can function as a circular-to-linear polarization converter and vice versa for wavelengths above $\lambda o$ by arranging the crossed dipoles or slots to have unequal lengths. The use of a dichroic plate as a polarization converter is particularly advantageous at high frequencies because of the difficulty in fabricating conventional microwave elements that function as polarization converters at these frequencies, particularly in the Ku band and above.

It is, accordingly, an object of the present invention to provide a new and improved dichroic plate including crossed dipole or slot elements.

A further object of the invention is to provide an improved crossed dipole or slot dichroic plate having a capability of passing a relatively wide band of radio frequency components.

A further object of the invention is to provide an improved, crossed dipole or slot dichroic plate that enables an increased number of radio frequency bands to be used simultaneously on a single Cassegrain antenna.

An additional object of the invention is to provide a new and improved crossed dipole or slot dichroic plate having a relatively high efficiency in the transmission and reflection of radio frequency energy.

A further object of the invention is to provide a new and improved crossed dipole or slot dichroic plate susceptible to having surfaces inclined significantly with respect to a boresight axis of a feed and wherein higher order mode losses and grating lobes of energy derived from the plate are substantially minimized.

An additional object of the invention is to provide a new and improved crossed dipole or slot dichroic plate having a relatively small separation between the centers of adjacent dipole elements.

Another object of the invention is to provide a new and improved dichroic plate capable of functioning as a high frequency, microwave polarization converter.

The above and still further objects, features and advantages of the present invention will become apparent upon consideration of the following detailed description of several specific embodiments thereof, especially when taken in conjunction with the accompanying drawing.

DETAILED DESCRIPTION OF THE INVENTION

Figure 1:
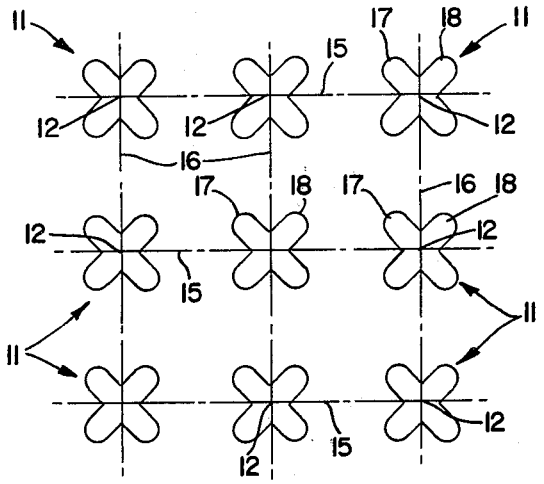
FIG. 1 PRIOR ART
FIG. 1, as previously indicated, is an illustration of a prior art, crossed dipole dichroic plate.
Figure 2:
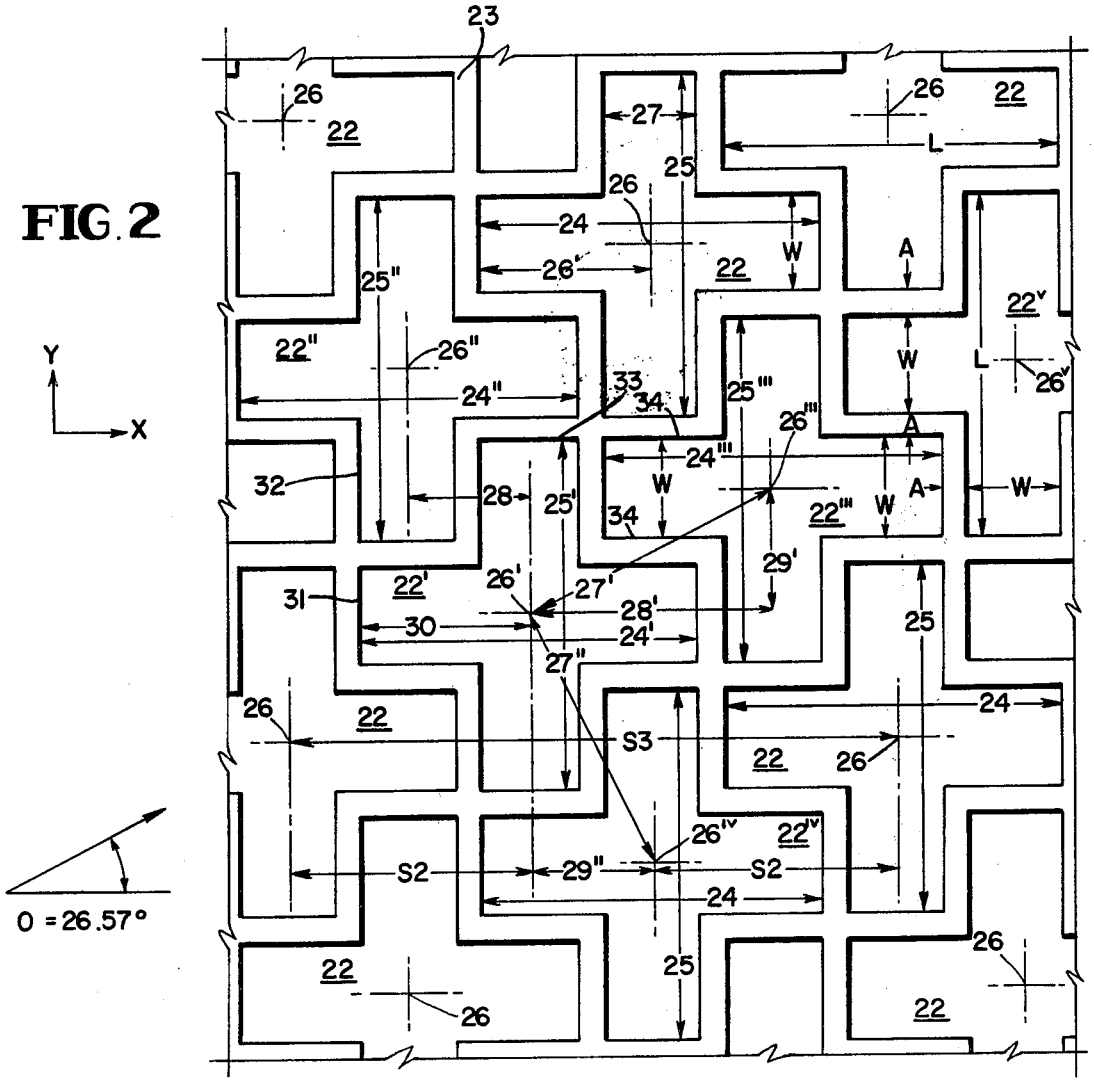
FIG. 2 is an illustration of one embodiment of a dichroic plate in accordance with the invention.

Reference is now made to FIG. 2 of the drawing wherein there is illustrated a dichroic plate including a multiplicity of interlaced, crossed slots 22. In the embodiment illustrated in FIG. 2, as well as FIGS. 4 and 5, the crossed slots 22 are illustrated as being apertures in a metal plate, between which apertures a metal lattice structure is formed; in FIG. 2 the lattice structure is indicated by reference numeral 23. It is to be understood, however, that the lattice structure and crossed slots 22 can be reversed so that the crossed slots become metallic segments separated by a dielectric. In the latter case, metallic segments are formed with printed circuit techniques by depositing a metal coating on a dielectric substrate and by etching away the lattice regions to form mutually insulated, crossed metal dipoles.

Each of the crossed slots 22 includes two crossed arms 24 and 25, having longitudinal axes that extend at right angles to each other and along lines that are parallel to X and Y axes of a Cartesian coordinate system. Arms 24 and 25 are approximately the same length, at least equal to ½ the wavelength of a cut-off frequency, $\lambda o$, for the dichroic plate. The cut-off frequency for the dichroic plate is the boundary frequency between the range of frequencies that is transmitted through the plate and the range of frequencies that is reflected by the plate. In the following description and the claims, the term dipole element is used as a generic term for metal segments on a dielectric or slots formed by a dielectric on a metal sheet, or the like, wherein the lengths of the arms of the element are approximately $\lambda o/2$. In one particular embodiment, the dichroic plate of the invention was utilized in a Cassegrain antenna to reflect S band, circularly polarized energy, in the frequency range from 2100 to 2300 mHz, and to pass circularly polarized energy in the Ku band, between 14.3 gHz and 15.25 gHz. The cut-off frequency of the particular plate was 14.3 gHz, energy having a wavelength of 0.825 inches.

Crossed slots 22 are considered as being interlaced because similarly directed arms of adjacent elements are in overlapping relationship, along one axis, with the adjacent crossed slots having their centers 26 spaced along the axis. In other words, the left portion 30 of arm 24' of slot 22' overlaps with the right portion 51 of arm 24'' of slot 22''. In the embodiment of FIG. 2, the overlap of arm 24' extends to the left edge of arm 25''. Similarly, arm 25' overlaps with a portion of arm 25''' of slot 22'''. The overlap between arms 25' and 25''' is the same as the overlap between arms 24' and arms 24''.

The interlaced or overlapped relationship is achieved by arranging centers 26 in columns and rows that extend parallel to the Y and X axes, respectively, so that lines 27 between the centers 26 of all adjacent slots 22 have non-zero, differing components relative to the X and Y axes. (To simplify the drawing only the lines 27 between centers 26', 26'' and $26^{IV}$ of elements 22, 22'' and $22^{IV}$ are shown). In particular, centers 26' and $26^{IV}$ of slots 22' and $22^{IV}$ are separated by line 27' that has a component 28' in the X axis direction and a component 29' in the Y axis direction, such that the components 28' and 29' differ in length from each other. In an opposite manner, line 27'' extends between centers 26' and $26^{IV}$ and includes components 28'' and 29'' along the Y and X axes, respectively. Components 28' and 28'' have equal lengths, as do components 29' and 29''.

Because of the right angled relationship between components 28 and 29, the length, $S_1$, of each line 27 between adjacent centers, is related to the length, $S_4$, of components 28 and the length, $S_2$, of component 29 by: $S_1^2 = S_2^2 + S_4^2$. In the embodiment of FIG. 2, the spacing, A, between adjacent arms of adjacent slots is always the same in the directions of the X and Y axes. Because of this factor, and an aligned relationship between the ends 31 of arms 24 and the edges 32 of arms 25, and an aligned relationship between the ends 33 of arms 25 and the edges 34 of the aligned arms 24, line segments 27 subtend an arc whose tangent is ½, i.e., 26.57°, relative to one of the X or Y axes. Further, the length, L, of each of the arms 24 or 25 is related to the width, W, of each of the arms (the distance separating the parallel edges, such as edges 34 and 34' of element 22''' transverse to the longitudinal axis of the elements) in accordance with L=3W+2A. For a minimum spacing, wherein A approaches zero, the length-to-width ratio of each element 22 approaches 3. The lengths of $S_1$, $S_2$ and $S_4$ can be shown to equal:

$$S_1 = \sqrt{\frac{5}{4}}\,(L+W+2A$$

$$S_2 = \frac{1}{2}\,(L+W+2A), \text{ and}$$

$$S_4 = W+A.$$

From the foregoing, it can be shown that if each dipole element has a length L equal to (λo)/2, the minimum center separation between adjacent slots 22 equals $\sqrt{5}/6\ \lambda o$, (approximately 0.37λo) as the spacing, A, approaches zero.

In a real situation, the metal thickness of perforated dichroic metal plates limits the spacing "A" to an order of magnitude approximately equal to the metal thickness. The length of the crossed dipole elements, L, is the prime dimension in selecting the cut-off frequency. From these parameters, A and L, the value of W is determined, which enables the center spacing, $S_1$, as well as the values of $S_2$ and $S_4$ to be determined. If for some reason, it is desired to have the length of each dipole element slightly longer than λo/2, which is feasible for the range $(\lambda o/2) \leqq L \leqq 3\lambda o/4$, the configuration of FIG. 2 can still be employed by determining the value of W from the relationship L=3W+2A, and then determining the values of $S_1$, $S_2$ and $S_4$.

Figure 3:
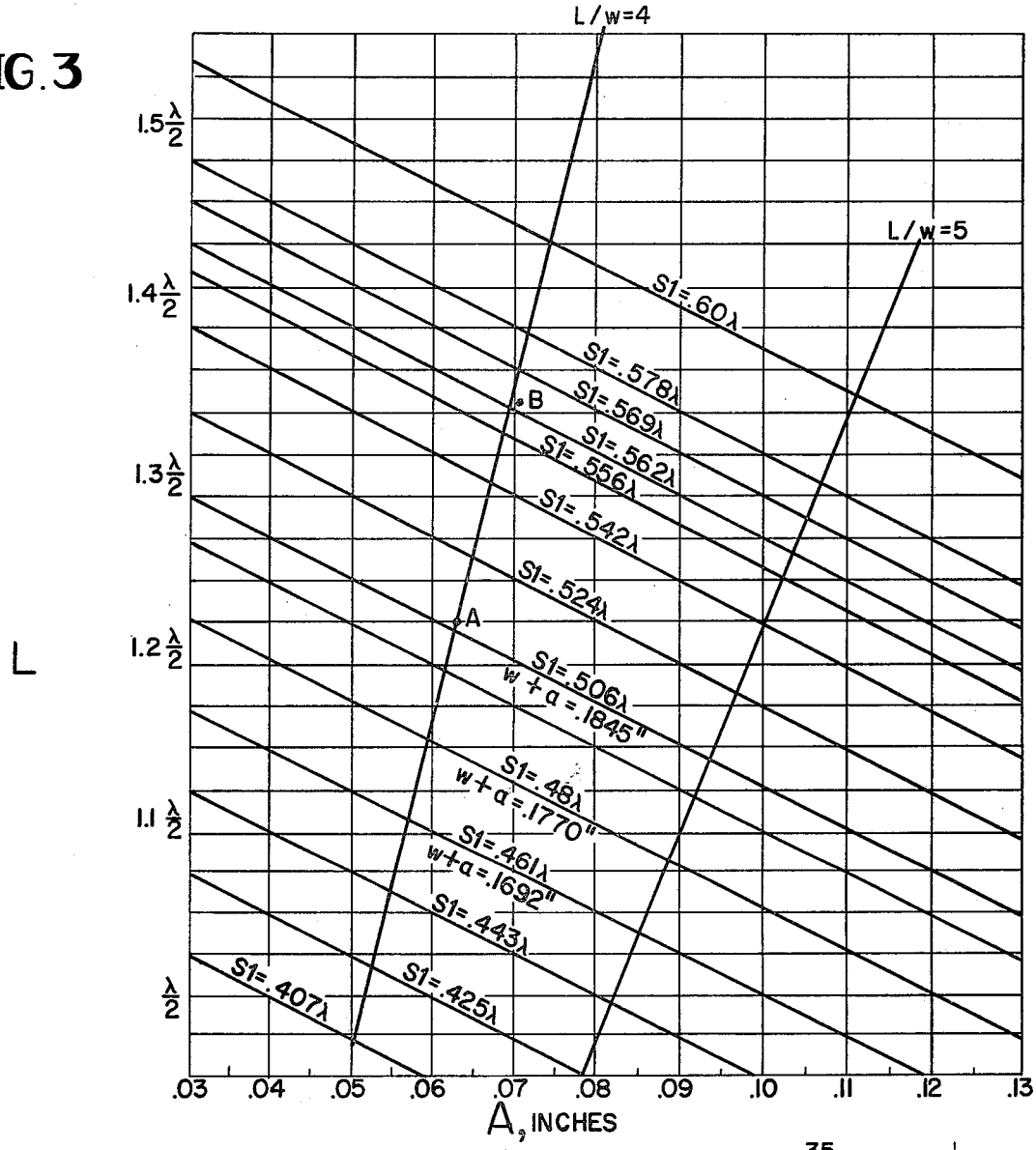
FIG. 3 is a series of plots indicating design criteria for dichroic plates of the type illustrated in FIG. 2.

The chart of FIG. 3 is based on the Equations:

$$A=(3/\sqrt{5})S_1-L \text{ for each fixed value of } S_1, \text{ and} \quad (1)$$

$$W=(S_1/\sqrt{5})-A, \quad (2)$$

and provides values of A versus element length, L, from λo/2 to 3λo/4, for L/W ratios of 4 and 5. FIG. 3 indicates the design criteria for the practical spacing range of 30 to 130 mils, for a single element cut-off frequency of 14.3 gHz, a frequency having a wavelength of 0.825 inches.

Figure 4:
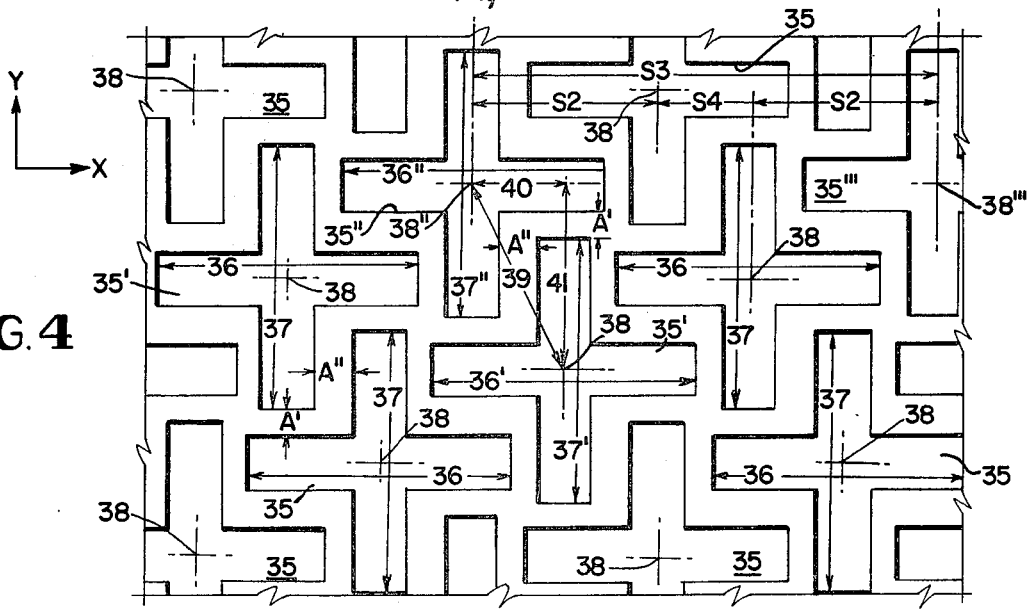
FIGS. 4 and 5 are illustrations of dichroic plates in accordance with two additional embodiments of the invention.

A uniform "A" provides the minimum L/W ratio. If W is reduced however, the center-to-center spacing can be reduced. As shown in FIG. 4, there is an array of interlaced crossed dipole elements in the form of crossed slots 35, having orthogonally directed arms 36 and 37 having longitudinal axes extending in the directions of the X and Y axes of a Cartesian coordinate system. Centers 38 of slots 35 lie in rows and columns that are parallel to the X and Y axes.

Arms 36 and 37 overlap with the corresponding arms of adjacent slots 35, with the overlap extending beyond the edges of the orthogonally directed arms of the adjacent slots. The interlacing between slots 35 is again such that each line between the centers 38 of all adjacent slots has non-zero differing components relative to the X and Y axes. In particular, line segment 39 between centers 38' and 38'' of slots 35' and 35'' includes components 40 and 41 that respectively extend parallel to the X and Y axes, and which have non-zero, differing values. The distance separating centers 38' and 38'' can be less in the configuration illustrated in FIG. 4 than in the configuration illustrated in FIG. 2 because the spacing, A'' between similarly directed arms of adjacent slots 35 differs from the spacing, A', between oppositely directed arms of adjacent slots 35. Hence, the spacing A'' between the right and left edges of arms 37' and 37'' of slots 35' and 35'' is greater than the spacing A' between the upper edge of arm 36' and the lower end of arm 37''. In the situation illustrated in FIG. 4, $A''=3A'/2$. Further, in FIG. 4, each of components 40, representing the shortest distance, in one of the X or Y axes directions, between adjacent center separations, has a length, $S_2$, that is ½ the length, $S_4$, of component 41, representing the longer center separation component in the direction of one of the X or Y axes, whereby the center separation is represented as $\sqrt{5}\ S_4$. This results in line 39 again subtending an arc whose tangent is ½ relative to one of the X or Y axes.

Specifically, if the width of each element in FIG. 4 is decreased by ΔW, relative to the width of the elements in FIG. 2, while holding the values of L, $S_1$, $S_2$, $S_3$ and $S_4$ constant, the values of A' and A'' can be determined as:

$$A'=\Delta W/2+A, \text{ and}$$

$$A''=\Delta W+A,$$

where $S_3$ is the center separation between adjacent pairs of crossed elements having centers spaced along the same lines parallel to the X or Y axes, so that e.g. in FIG. 2, $S_3$ is the distance between centers 26'' and 26^v, while in FIG. 4, $S_3$ is the distance between centers 38'' and 38'''.

In general (FIG. 2 or FIG. 4) the spacing can be increased or reduced by a multiplying factor K giving:

$$S2'=K(S2)$$

$$S4'=K(S4)$$

and, $$A'=S2'-(L+W)/2$$

$$A''=S4'-W$$

and, $$(S1')^2=(S2')^2+(S4')^2,$$

where S2 and S4 are the values for the equal spacing (A) embodiment of FIG. 2; FIG. 2 is for the special case of K=1. The value of K can be greater or less than unity. The line connecting the centers of adjacent elements subtends an angle relative to the X or Y axis that remains constant for any value of K, because $$\phi = \tan^{-1}\frac{S4'}{S2'} = \tan^{-1}\frac{KS4}{KS2} = \tan^{-1}\frac{S4}{S2}.$$

For a fixed value of L, and using K=1 as a reference, the geometry can be varied for two important parameters, namely W and S1. It can be shown empirically and theoretically that the bandwidth increases as the spacing $S_1$ is reduced, and the bandwidth decreases as the width decreases or L/W increases.

For small values of L/W, the spacing is limited by the allowable metal thickness between slots or the allowable air gap between dipoles. For large values of L/W, the spacing can be greatly reduced. Other factors such as power handling or fabrication constraints can fix a lower limit on gap or element width. Consequently, bandwidth can be optimized for a given fabrication capability and/or power handling requirement.

Figure 5:
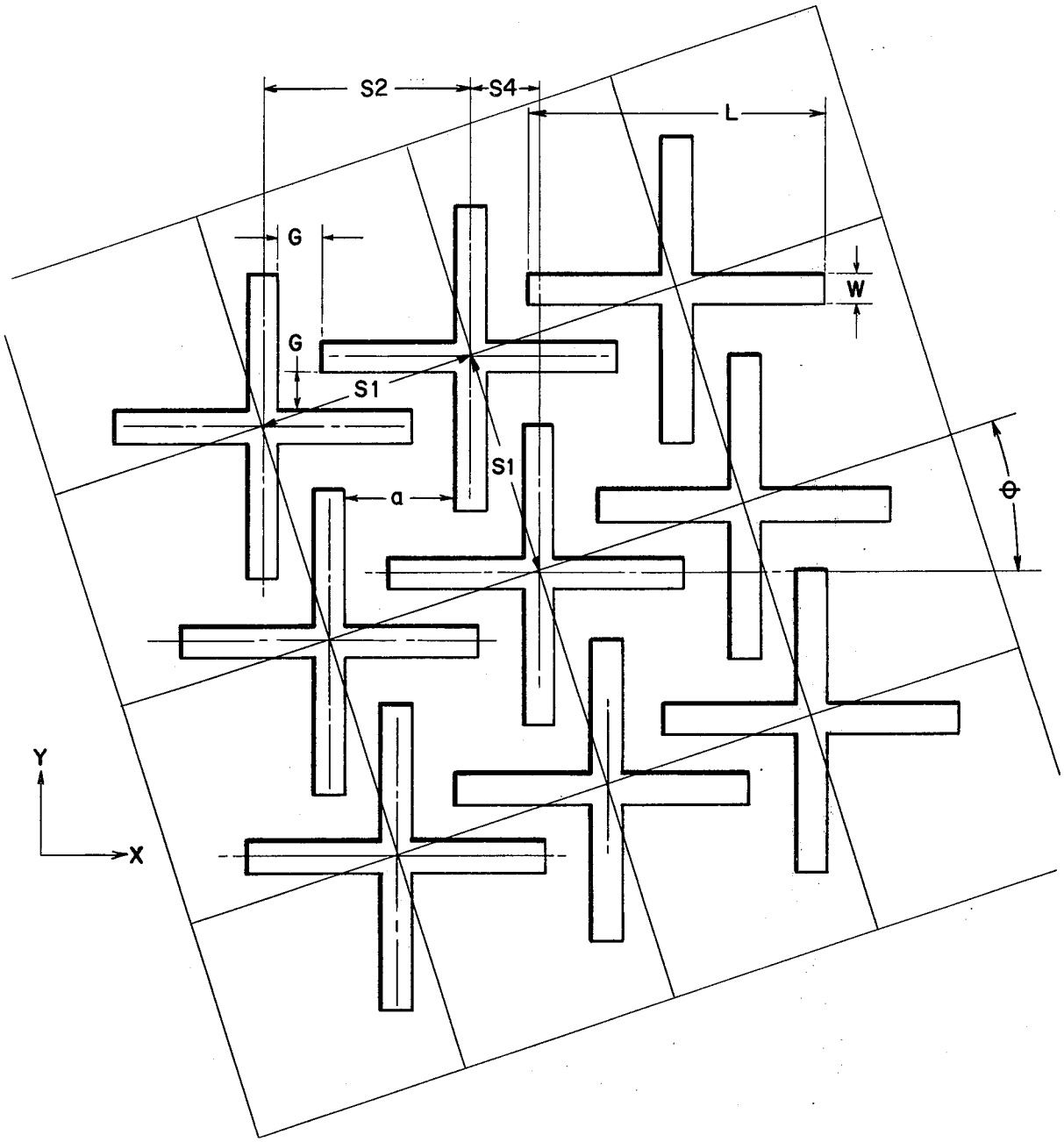

As shown in FIG. 5, the spacing between the centers of adjacent elements and the W/L ratio can both be reduced by decreasing S4 so that the arm-to-arm gap in FIG. 4 is the same as the arm-to-tip gap. In FIG. 5, the gap or spacing, G, between adjacent, parallel edges of adjacent first and second arms of first and second elements along one of the X or Y coordinate directions equals the gap or spacing, G, between the tip of the first arm and the edge of a third arm of the second element along the other coordinate direction, wherein the first and second arms extend along a first of the coordinate directions and the third arm extends along a second of the coordinate directions. As in FIGS. 2 and 4, the elements are arranged so that the centers thereof are aligned parallel to the X and Y axes to form columns and rows. Further, the interlacing between adjacent elements is such that a line between the centers of all adjacent elements has nonzero, differing components relative to the X and Y axes.

From FIG. 5, it is apparent that the center separation $S_1$ is related to the width, W, of each arm, the gap, G, the separations S2 and S4 between the centers of the arms of adjacent elements along both the X and Y axes by the following equations:

$$S4=W+G$$

$$S2=L/2+W/2+G$$

$$(S1)^2=(S4)^2+(S2)^2.$$

Note that $S4 \neq S2/2$ and $$\phi = \tan^{-1}\frac{S4}{S2} = \frac{W+G}{S2} \neq \tan^{-1}\frac{1}{2}.$$

The separation, a, of adjacent edges of similarly directed remote arms of adjacent elements is given by:

$$a=S2-S4-W.$$

It can be shown that if G and W/L approach zero, the limit in center-to-center spacing approaches $0.25\lambda o$ for $L=0.5\lambda o$.

In the embodiment illustrated in FIG. 5, $L=0.5\lambda o$, $L/W=0.5/0.045=11.11$, $S1=0.312\lambda o$, $S2=0.3025\lambda o$, $S4=0.075\lambda o$, and $\theta=\tan^{-1}(S4/S2)=\tan^{-1}(0.075/0.3025)=13.92°$.

From these data, it is apparent that there is a further reduction in center separation and that W/L is the relatively small quantity 0.0909.

It is the intent of these embodiments to illustrate the design optimization and design versatility that is provided by the interlaced concept as opposed to the prior art.

While there have been described and illustrated several specific embodiments of the invention, it will be clear that variations in the details of the embodiments specifically illustrated and described may be made without departing from the true spirit and scope of the invention as defined in the appended claims.

What is claimed is:

1. A dichroic plate for reflecting microwave energy within a certain frequency band and for passing microwave energy within another frequency band, said plate having an array of interlaced elements, each of said elements having first and second orthogonal arms of approximately the same length which are crossed at a point at the middle thereof, said arms being arranged with their center lines aligned parallel to the X and Y axes of the array, the arrangement of said elements being such that a line between the points of crossing of the arms of the closest adjacent elements has differing component values relative to said X and Y axes.

2. The plate of claim 1 wherein the line between the points of crossing of the arms of closest adjacent elements subtends an angle of a maximum value of 26.57° relative to one axis of the array.

3. The plate of claim 1 wherein said elements are unloaded.

4. The plate of claim 1 wherein the spacing between said elements in the array is uniform throughout.

5. The plate of claim 1 wherein the ratio of the length of each arm along one axis to the width of the arm along the other axis approaches a minimum of 3 to 1.

6. The plate of claim 1 wherein the spacing between said elements in the array is non-uniform throughout.

7. The plate of claim 1 wherein the minimum separation between the points of crossing of the arms of closest adjacent elements approaches one-half of the arm length as the arm width diminishes.

* * * * *